US006199538B1

(12) United States Patent
Aota et al.

(10) Patent No.: US 6,199,538 B1
(45) Date of Patent: Mar. 13, 2001

(54) FUEL INJECTION VALVE FOR THE CYLINDER INJECTION

(75) Inventors: Masayuki Aota; Osamu Matsumoto, both of Tokyo; Tsuyoshi Munezane, Hyogo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/197,605

(22) Filed: Nov. 23, 1998

(30) Foreign Application Priority Data

Jul. 1, 1998 (JP) ..... 10-186089

(51) Int. Cl.[7] ..... F02M 37/04
(52) U.S. Cl. ..... 123/470; 123/456
(58) Field of Search ..... 129/470, 469, 129/468, 456, 509

(56) References Cited

U.S. PATENT DOCUMENTS 4,294,215 * 10/1981 Hans ..... 123/469
4,395,988 * 8/1983 Knapp ..... 123/469
5,038,738 * 8/1991 Hafner ..... 123/470
5,044,340 * 9/1991 Robnett ..... 123/472
5,217,204 * 6/1993 Maier ..... 123/472
5,630,400 * 5/1997 Sumida et al. .
5,934,252 * 8/1999 Hafner ..... 123/468
5,934,253 * 8/1999 Kojima ..... 123/469

FOREIGN PATENT DOCUMENTS 10-47199 * 2/1998 (JP) .

* cited by examiner

*Primary Examiner*—Carl S. Miller
(74) *Attorney, Agent, or Firm*—Sughrue, Mion, Zinn, Macpeak & Seas, PLLC

(57) ABSTRACT

A fuel injection valve for the cylinder injection 100 comprising: a valve assembly 3 which injects fuel; a solenoid assembly 26 which opens and closes the valve assembly 3; a housing 102 which accommodates the valve assembly 3 and the solenoid assembly 26; and a core 33 which also functions as a fuel pipe which connects The valve assembly 3 to a delivery pipe 4. The core 33 comprises: a delivery-pipe-side pressure-receiving portion 150 which is disposed within the delivery pipe 4 and is subjected to fuel pressure from within the delivery pipe 4; a housing-side pressure-receiving portion 140 which is connected to the valve assembly 3 within the housing 102 and is subjected to fuel pressure from within the housing 102; and a fastening portion 33*d* disposed between these two pressurized portions to fasten the core 33 to the housing 102. The pressure-receiving surface area $S_B$ of the delivery-pipe-side pressure-receiving portion 150 is greater than the pressure-receiving surface area $S_A$ of the housing-side pressure-receiving portion 140.

7 Claims, 3 Drawing Sheets

FUEL INJECTION VALVE FOR THE CYLINDER INJECTION

BACKGROUND OF THE INVENTION

1. Field of the Invention

The present invention relates to a fuel injection valve for the cylinder injection of fuel which injects fuel directly into the combustion chamber of an internal combustion engine.

2. Description of the Related Art

An example of a conventional (but not prior art) fuel injection valve 1 for the cylinder injection is shown in FIGS. 2 to 4.

FIG. 2 shows a cross-sectional view of a fuel injection valve 1 for the cylinder injection. In the figure, the tip of the fuel injection valve 1 for the cylinder injection is inserted into an injection valve socket 6 in a cylinder head 5 in an internal combustion engine. A flange portion 2*a* of a housing 2 is held by a generally plate-shaped fork 28, and the fuel injection valve 1 for the cylinder injection is attached to the cylinder head 5 by securing the fork 28 to the cylinder head 5 by means of a bolt 29. A seal is formed between the cylinder head 5 and the fuel injection valve 1 for the cylinder injection by means of a corrugated washer 160.

The fuel injection valve 1 for the cylinder injection comprises the above housing 2 and a valve assembly 3 supported by one end of this housing 2 by a fastening means such as caulking.

The valve assembly 3 comprises: a stepped, hollow, cylindrical valve main body 9 which has a small-diameter cylinder portion 7 and a large-diameter cylinder portion 8; a valve seat 11 which has a fuel injection hole 10 and is secured to the tip of the central hole within the valve main body 9; a needle valve 12 which is a valve body which is moved in and out of contact with the valve seat 11 by means of a solenoid assembly 26 to close and open the fuel injection hole 10; and a swirler body 13 which guides the needle valve in the axial direction and also imparts a swirling motion to the fuel as it is about to flow radially inward into the fuel injection hole 10 of the valve seat 11.

The solenoid assembly 26, which comprises a coil 27, is disposed within the housing 2. A core 33 which, together with an armature 30 and the housing 2, defines a magnetic circuit is disposed within the solenoid assembly 26. Within the core 33, there are cylindrical bores 33*a* and 33*b* of different diameter. A spring 31 which pushes the needle valve 12 against the valve seat 11 and a hollow cylindrical rod 32 which adjusts the tension in the spring 31 are disposed in the cylindrical bore 33*a*, and a fuel filter 34 is disposed in the cylindrical bore 33*b*.

In addition, a delivery pipe O-ring 35 is disposed around the outside of one end of the core 33 between backup rings 36, 37 to prevent fuel which is supplied to the fuel injection valve 1 for the cylinder injection from the high-pressure fuel pump, which is not shown, via the inside of the delivery pipe 4 from leaking between the core 33 and the delivery pipe 4.

A bush 38, which has a thin cylindrical wall 38*a*, is disposed around the outside of the other end of the core 33 adjacent to the solenoid assembly 26. An external O-ring 40 is disposed around the outside of this thin cylindrical wall 38*a* to form a seal between the housing 2 and the thin cylindrical wall 38*a* of the bush 38, and an internal O-ring 41 is disposed around the inside of the thin cylindrical wall 38*a* to form a seal between the core 33 and the thin cylindrical wall 38*a* of the bush 38, so that fuel is prevented from seeping into the coil 27. Also, a spacer 39 is disposed on the opposite side of the external O-ring 40 and internal O-ring 41 from the coil 27 to position the external O-ring 40 and the internal O-ring 41 in the axial direction.

FIG. 3 is an enlarged sectional view showing the vicinity of the swirler body 13, which constitutes part of the valve assembly 3, and FIG. 4 is a view of the swirler body 13 from the direction of an arrow X of FIG. 3. In FIGS. 3 and 4, the swirler body 13 is a hollow, generally-cylindrical member which has a central bore 15 which surrounds and centrally supports the needle valve 12 which is a valve member, so that it can slide in the axial direction, and the swirler body 13 comprises: a first end surface 16 which comes into contact with the valve seat 11 when assembled in the valve assembly 3; a second end surface 17 at the opposite end from the valve seat 11; and an outer surface 19 between these two end surfaces which comes into contact with a curved inner surface 18 of the valve main body 9.

The second end surface 17 of the swirler body 13 comes into contact with and is supported around its circumference by a shoulder portion 20 on the curved inner surface 18 of the valve main body 9, and has passage grooves 21 formed therein which extend radially and allow fuel to flow from the inner portion to the radially outer portion of the second end surface 17.

A plurality of flat surfaces which extend in the axial direction and are spaced evenly around the circumference are formed in the outer surface 19 of the swirler body 13, and as a result, in the outer surface 19 there are formed: a plurality of curved outer surface portions which come into contact with the curved inner surface 18 of the valve main body 9 and regulate the position of the outer surface 19 with respect to the valve main body 9; and channel portions 23 which are flat surfaces disposed between these curved outer surface portions and, together with the curved inner surface 18, defines axial channels 22 for the fuel. These axial channels 22 are the spaces between the curved inner surface 18 of the valve main body 9 and the flat channel portions 23, and so they have a substantially D-shaped cross-section (shaded portion in FIG. 4).

In the first end surface 16 of the swirler body 13 which faces the valve seat 11, there are disposed: an inner annular groove 24 of a prescribed width formed on the inside edge where the first end surface 16 meets the central bore 15; and rotation grooves 25 which are connected at one end to the channel portions 23 of the outer surface 19, extend generally radially inwards from there at a tangent to the inner annular groove 24, and are connected at a tangent to the inner annular groove 24 at the other end.

In the fuel injection valve 1 for the cylinder injection constructed in this way, the fuel in the delivery pipe 4 passes through the fuel filter 34, through the cylindrical bore in the rod 32, through the cylindrical bore 33*a* in the core 33, and through the cylindrical bore in the armature 30, then passes through a two-sided cut portion 12*a* on the needle valve 12, through an opening in a U-shaped stopper 42, and around a four-sided cut portion 12*b* on the needle valve 12, and is fed as far as the swirler body 13.

When electricity is supplied to the coil 27, magnetic flux is generated in the magnetic circuit formed by the armature 30, the core 33, and the housing 2, and the armature 30 is attracted towards the core 33. The needle valve 12, which moves together with the armature 30, is separated from the valve seat 11, forming a gap, and fuel flows first via the passage grooves 21 in the second end surface 17 of the swirler body 13 through the axial channels 22 in the outer surface 19, flows radially inwards into the rotation grooves 25 in the first end surface 16, flows into the inner annular groove 24 of the first end surface 16 at a tangent thereto and forms a swirling current, then enters the injection hole 10 of the valve seat 11 and is sprayed from the outlet at the tip thereof.

In the fuel injection valve 1 for the cylinder injection constructed in this way, the fastening portion 33*d* in the flange portion 33*c* of the core 33, where the core 33 is fastened to the housing 2, is conventionally caulked to prevent the core 33 from being dislodged in the axial direction with respect to the housing 2 due to the high pressure of the fuel flowing therein. In addition, the fastening portion 33*d* is conventionally welded, etc., around its circumference to increase its strength. The relationship between the forces acting on the fastening portion 33*d* will now be explained using FIG. 2.

In the figure, letter A indicates the inside diameter (mm) of the inner circumferential surface 2*d* of the housing 2, into which the external O-ring 40 is, and letter B indicates the inside diameter (mm) of the inner circumferential surface 4*a* of the delivery pipe 4, into which the delivery pipe O-ring 35 is inserted. The pressure (MPa) of the fuel in the delivery pipe 4 is designated by P.

In the conventional construction for a fuel injection valve for the cylinder injection, A is conventionally greater than B, so that a force of $(\pi/4)\times(A^2-B^2)\times P$ acts on the fastening portion 33*d* in the direction of an arrow C. Consequently, the fuel pushes the core 33 in the direction of the arrow C, a direction which loosens the caulking of the fastening portion 33*d*. As a result, the core 33 is dislodged in the axial direction with respect to the housing 2, which changes the air gap 43 between the end of the armature 30 and the end of the core 33. The problem is that the change in the air gap changes the force of attraction of the solenoid assembly 26 which raises the needle valve 12, which in turn changes the amount of fuel which is injected into the cylinder head 5.

In order to solve the above problem, the dislodgment of the core 33 in the axial direction with respect to the housing 2 has conventionally been prevented by caulking the fastening portion 33*d* of the core 33, where the core 33 is fastened to the housing 2, and additionally welding, etc., the fastening portion 33*d* around its circumference to increase its strength, as described above, but the problem is that this requires welding in addition to caulking and leads to increased costs.

SUMMARY OF THE INVENTION

The present invention aims at solving the above problems and an object of the present invention is to provide a fuel injection valve for the cylinder injection capable of preventing the fastening portion between the core and the housing from being loosened by the effects of fuel pressure, as well as reducing the expense of the fastening between the core and the housing.

The injection valve for the cylinder injection of fuel according to the present invention is characterized in that it comprises: a valve assembly which injects fuel; a solenoid which opens and closes the valve assembly; a housing which accommodates the valve assembly and the solenoid; and a fuel pipe device which connects the valve assembly to a delivery pipe; wherein the fuel pipe device comprises: a delivery-pipe-side pressure-receiving portion which is disposed within the delivery pipe and is subjected to fuel pressure from within the delivery pipe; a housing-side pressure-receiving portion which is connected to the valve assembly within the housing and is subjected to fuel pressure from within the housing; and a fastening portion disposed between these two pressure-receiving portions to fasten the fuel pipe device to the housing; wherein the surface area of the delivery-pipe-side pressure-receiving portion is greater than the surface area of the housing-side pressure-receiving portion.

According to the fuel injection valve for the cylinder injection of the present invention, the delivery-pipe-side pressure-receiving portion may also comprise an O-ring which forms a seal between the fuel pipe device and the delivery pipe.

According to the fuel injection valve for the cylinder injection of the present invention, the housing-side pressure-receiving portion may also comprise an O-ring which forms a seal between the fuel pipe device and the housing.

According to the fuel injection valve for the cylinder injection of the present invention, the fuel pipe device may also comprise: a fuel pipe which is connected to the delivery pipe; and a core portion which is formed integrally with the fuel pipe and forms a magnetic circuit for the solenoid.

DESCRIPTION OF THE PREFERRED EMBODIMENT

Figure 1:
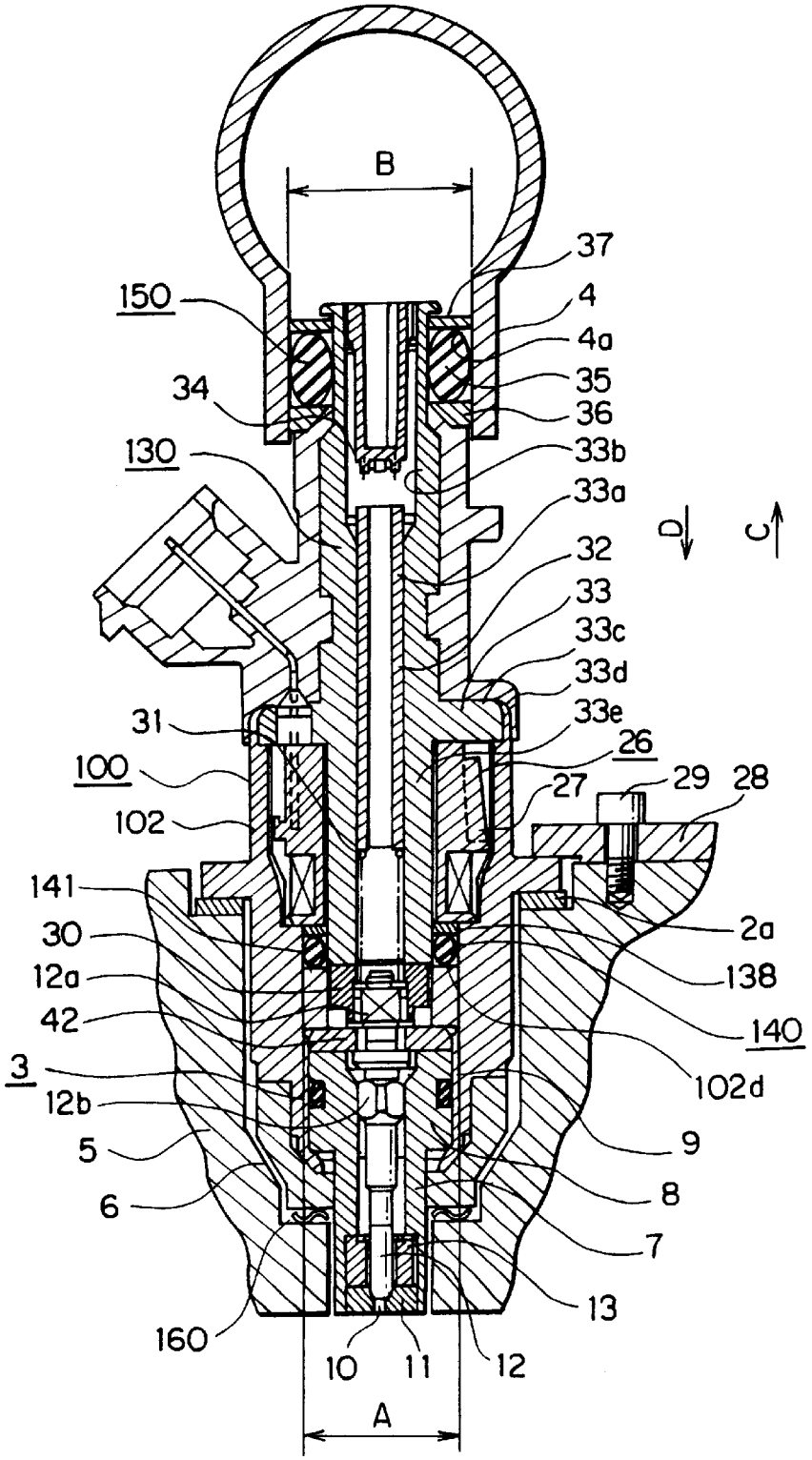
FIG. 1 is a cross-sectional view of the fuel injection valve for the cylinder injection of the embodiment of the present invention.

FIG. 1 is a cross-sectional view showing a fuel injection valve for the cylinder injection of fuel 100 which is an embodiment of the present invention. In the figure, parts having the same numbers as the conventional example in FIG. 2 indicate identical or corresponding parts.

A valve assembly 3 which injects fuel comprises as its main components: a stepped, hollow, cylindrical valve main body 9 which has a small-diameter cylinder portion 7 and a large-diameter cylinder portion 8; a valve seat 11 which has a fuel injection hole 10 and is secured to the tip of the central hole within the valve main body 9; a needle valve 12 which is a valve body which is moved in and out of contact with the valve seat 11 by means of a solenoid assembly 26 to close and open the fuel injection hole 10; and a swirler body 13 which guides the needle valve in the axial direction and also imparts a swirling motion to the fuel as it is about to flow radially inward into the fuel injection hole 10 of the valve seat 11.

The solenoid assembly 26, which opens and closes the valve assembly 3, comprises a coil 27 and is accommodated together with the valve assembly 3 in a housing 102.

The main components of a fuel pipe device 130 include: a core 33 which is shaped such that it also functions as a fuel pipe which extends integrally from a core portion 33*e* which forms a magnetic circuit opposite the solenoid assembly 26 into the delivery pipe 4 to transport fuel from the delivery pipe 4 to the valve assembly 3; a hollow cylindrical spacer 138; a housing O-ring 141; a delivery pipe O-ring 35; and backup rings 36, 37; and the fuel pipe device 130 is disposed so as to connect the valve assembly 3 to the delivery pipe 4.

In this fuel pipe device 130, there are disposed: a delivery-pipe-side pressure-receiving portion 150 which comprises the delivery pipe O-ring 35, is disposed in the delivery pipe 4, and is subjected to fuel pressure from within the delivery pipe 4; a housing-side pressure-receiving portion 140 which is connected to the valve assembly 3 as a fuel passage within the housing 102, comprises the housing O-ring 141, and is subjected to fuel pressure from within the housing 102; and a fastening portion 33*d* disposed between the delivery-pipe-side pressure-receiving portion 150 and the housing-side pressure-receiving portion 140 to fasten the fuel pipe device 130 to the housing 102.

The inner circumferential surface 4*a* of the delivery pipe 4 is a cylindrical surface and its inside diameter is B. The delivery-pipe-side pressure-receiving portion 150, which is subjected to the pressure of the fuel from within the delivery pipe 4 in the direction of D, is formed in this inner circumferential surface 4*a* and the delivery pipe O-ring 35, which forms a seal between the delivery pipe 4 and the core 33 which also functions as a fuel pipe, is disposed therein. The outside diameter of the delivery-pipe-side pressure-receiving portion 150 when it is inserted into the delivery pipe 4 is B, and the pressure-receiving surface area thereof is given by $S_B=(\pi/4)\times B^2$.

Figure 2:
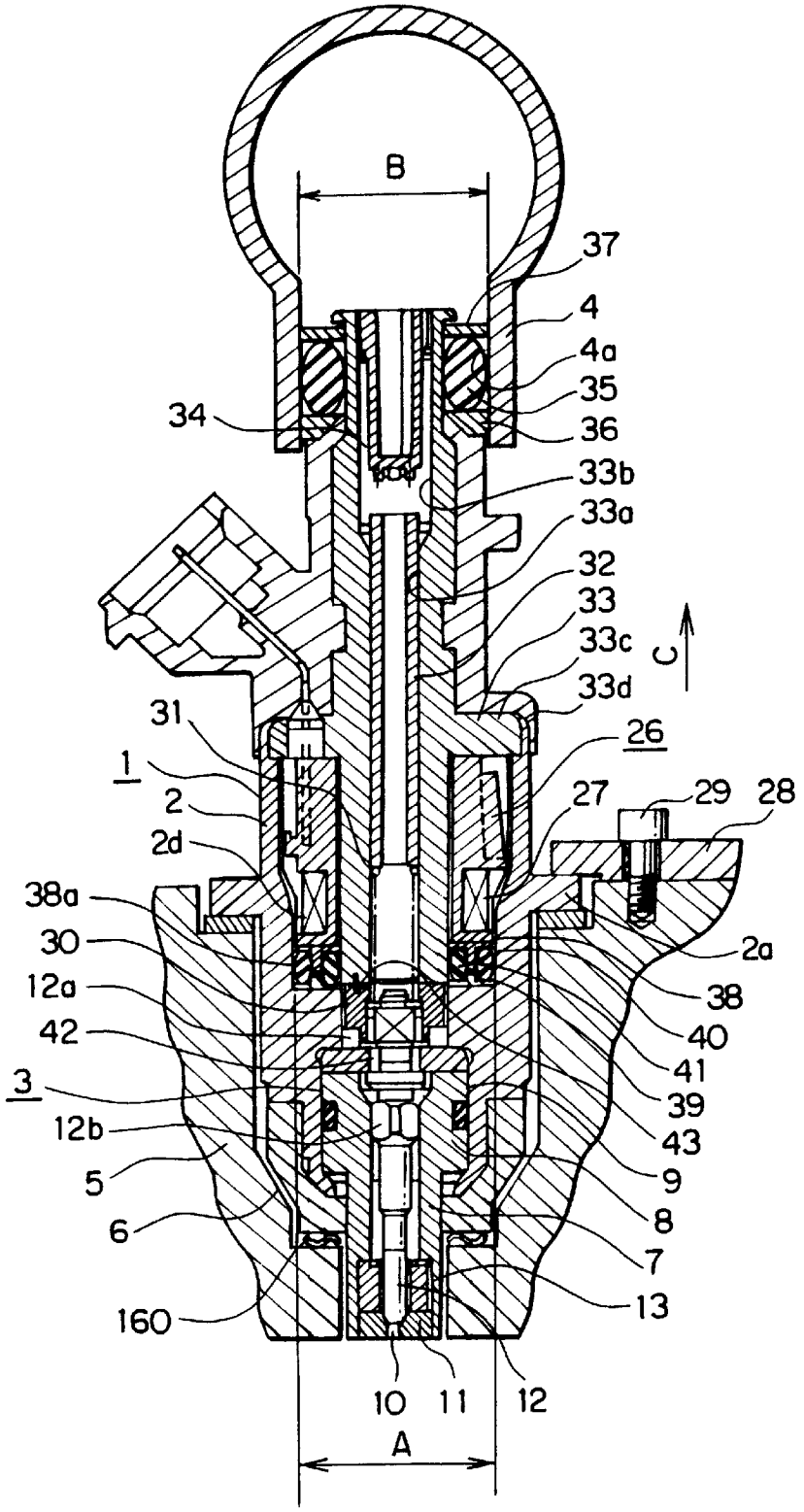
FIG. 2 is a cross-sectional view of a conventional fuel injection valve for the cylinder injection.
Figure 3:
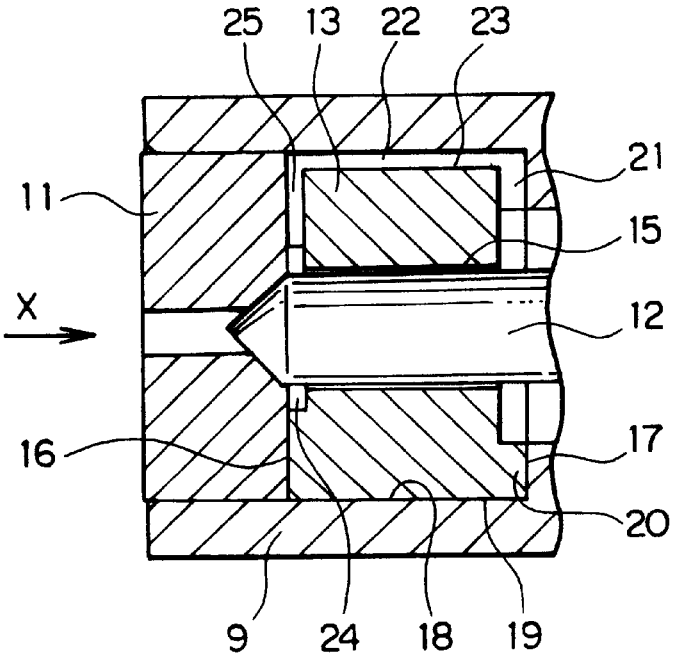
FIG. 3 is an enlarged cross-sectional view showing the vicinity of the swirler body 13 of a conventional fuel injection valve for the cylinder injection.
Figure 4:
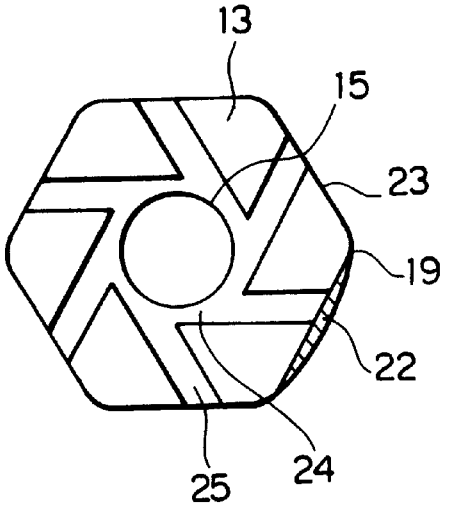
FIG. 4 is a view from the direction of the arrow X in FIG. 3.

The difference between this embodiment and the conventional example in FIG. 2 is in the seal construction formed by the housing-side pressure-receiving portion 140 which is disposed between the core 33 which also functions as a fuel pipe and the housing 102 which is disposed in a position adjacent to the solenoid assembly 26 on the outside of the core 33, and is subjected to the pressure of the fuel from within the housing 102 in the direction of C.

The hollow cylindrical spacer 138 is disposed adjacent to the solenoid assembly 26. The housing O-ring 141, which forms a seal between the inner circumferential surface 102*d* of inside diameter A of the recessed portion of the housing 102 and the outside of the core 33, is disposed adjacent to the spacer 138 and prevents fuel from seeping into the coil 27. The outside diameter of the housing-side pressure-receiving portion 140 when it is inserted into the housing 102 is A, and the pressurized surface area thereof is given by $S_A=(\pi/4)\times A^2$.

These two pressurized portions are formed such that the pressure-receiving surface area $S_B$ of the delivery-pipe-side pressure-receiving portion 150 is greater than the pressure-receiving surface area $S_A$ of the housing-side pressure-receiving portion 140.

Consequently, in the construction of this fuel injection valve 100 for the cylinder injection, a force of $(\pi/4)\times(B^2-A^2)\times P$ acts on the fastening portion 33*d* in the direction of the arrow D. For that reason, the fastening portion 33*d* is acted on by the force of the fuel in the direction of the arrow D, so that the caulking of the fastening portion 33*d* is unlikely to be loosened. As a result, the core 33 is unlikely to be dislodged in the axial direction with respect to the housing 2, and the air gap 43 is unlikely to change. Consequently, the force of attraction of the solenoid assembly 26 which raises the needle valve 12 can be maintained constant and the amount of fuel which is injected into the cylinder head 5 can be stabilized.

Also, the fastening portion 33*d* is not acted on by the force of the fuel in the direction of the arrow C, so that fastening by caulking is sufficient and welding, etc., is not required.

In this embodiment, the construction of the housing-side pressure-receiving portion 140 employs a spacer 138 and a housing O-ring 141, but provided that the pressurized surface area $S_B$ of the delivery-pipe-side pressure-receiving portion 150 is greater than the pressurized surface area $S_A$ of the housing-side pressure-receiving portion 140, a construction employing an external O-ring 40 and internal O-ring 41 of reduced outside diameter, as shown in FIG. 2, may also be used. The inside diameter of the inner circumferential surface 4*a* of the delivery pipe 4 may also be increased at the housing-side pressure-receiving portion 140.

The core 33 is constructed to also serve as a fuel pipe, but a fuel pipe connecting the delivery pipe 4 to the valve assembly 3 may also be provided separately from the core 33.

The fuel injection valve for the cylinder injection according to the present invention comprise: a valve assembly which injects fuel; a solenoid which opens and closes the valve assembly; a housing which accommodates the valve assembly and the solenoid; and a fuel pipe device which connects the valve assembly to a delivery pipe; wherein said fuel pipe device comprises: a delivery-pipe-side pressure-receiving portion which is disposed in the delivery pipe and is subjected to fuel pressure from within the delivery pipe; a housing-side pressure-receiving portion which is connected to the valve assembly within the housing and is subjected to fuel pressure from within the housing; and a fastening portion disposed between these two pressure-receiving portions to fasten the fuel pipe device to the housing; wherein the pressure-receiving surface area of the delivery-pipe-side pressure-receiving portion is greater than the pressure-receiving surface area of the housing-side pressure-receiving portion, so that the fastening at the fastening portion between the core and the housing is prevented from being loosened by the effects of fuel pressure, and the expense of the additional fastening between the core and the housing is reduced.

In the fuel injection valve for the cylinder injection according to the present invention, the delivery-pipe-side pressure-receiving portion further comprises an O-ring which forms a seal between the fuel pipe device and the delivery pipe, so that, the construction of the delivery-pipe-side pressure-receiving portion is simplified.

In the fuel injection valve for the cylinder injection according to the present invention, the housing-side pressure-receiving portion further comprises an O-ring which forms a seal between the fuel pipe device and the housing, so that, the construction of the housing-side pressure-receiving portion is simplified.

In the injection fuel valve for the cylinder injection according to the present invention, the fuel pipe device further comprises: a fuel pipe which is connected to the delivery pipe; and a core portion which is integral with the fuel pipe and forms a magnetic circuit for the solenoid; so that, there is no need to provide the fuel pipe and core portions as separate members and costs can be reduced.

What is claimed is:

1. A fuel injection valve for the cylinder injection comprising:

a valve assembly which injects fuel;

a solenoid which opens and closes said valve assembly;

a housing which accommodates said valve assembly and said solenoid; and a fuel pipe device which connects said valve assembly to a delivery pipe;

said fuel pipe device comprising:

a delivery-pipe-side pressure-receiving portion which is disposed within said delivery pipe and is subjected to fuel pressure from within said delivery pipe;

a housing-side pressure-receiving portion which is connected to said valve assembly within said housing and is subjected to fuel pressure from within said housing and exterior to said fuel pipe device; and a fastening portion disposed between said two pressure-receiving portions to fasten said fuel pipe device to said housing;

wherein the surface area of said delivery-pipe-side pressure-receiving portion is greater than the surface area of said housing-side pressure-receiving portion.

2. The fuel injection valve for the cylinder injection according to claim 1, wherein said delivery-pipe-side pressure-receiving portion comprises an O-ring which forms a seal between said fuel pipe device and said delivery pipe.

3. The fuel injection valve for the cylinder injection according to claim 2, wherein said housing-side pressure-receiving portion comprises an O-ring which forms a seal between said fuel pipe device and said housing.

4. The fuel injection valve for the cylinder injection according to claim 3, wherein said fuel pipe device comprises:

a fuel pipe which is connected to said delivery pipe; and a core portion which is integral with said fuel pipe and defines a magnetic circuit for the solenoid.

5. The fuel injection valve for the cylinder injection according to claim 1, wherein said housing-side pressure-receiving portion comprises an O-ring which forms a seal between said fuel pipe device and said housing.

6. The fuel injection valve for the cylinder injection according to claim 5, wherein said fuel pipe device comprises:

a fuel pipe which is connected to said delivery pipe; and a core portion which is integral with said fuel pipe and defines a magnetic circuit for the solenoid.

7. The fuel injection valve for the cylinder injection according to claim 1, wherein said fuel pipe device comprises:

a fuel pipe which is connected to said delivery pipe; and a core portion which is integral with said fuel pipe and defines a magnetic circuit for the solenoid.

* * * * *